US005694802A

United States Patent [19]

Tanaka et al.

[11] Patent Number: 5,694,802

[45] Date of Patent: Dec. 9, 1997

[54] APPARATUS FOR FORMING SNAP RING GROOVE IN CLUTCH DRUM

[75] Inventors: Haruo Tanaka; Tadaaki Inaba, both of Sayama, Japan

[73] Assignee: Honda Giken Kogyo Kabushiki Kaisha, Tokyo, Japan

[21] Appl. No.: 544,071

[22] Filed: Oct. 17, 1995

[30] Foreign Application Priority Data

| | | | |
|---|---|---|---|
| Nov. 7, 1994 | [JP] | Japan | 6-272235 |
| Nov. 7, 1994 | [JP] | Japan | 6-272236 |
| Dec. 20, 1994 | [JP] | Japan | 6-317212 |

[51] Int. Cl.[6] ..... B21D 22/00; B21D 41/02

[52] U.S. Cl. ..... 72/353.6; 72/393; 72/354.2

[58] Field of Search ..... 72/353.6, 452.1, 72/452.8, 482.9, 354.2, 393

[56] References Cited

U.S. PATENT DOCUMENTS

| | | | |
|---|---|---|---|
| 2,421,935 | 6/1947 | Gosnell, Jr. | 72/393 |
| 3,314,276 | 4/1967 | Peyton et al. | 72/393 |
| 5,222,380 | 6/1993 | Halesz et al. | 72/393 |

FOREIGN PATENT DOCUMENTS 3-41858 3/1991 Japan .

*Primary Examiner*—Lowell A Larson
*Assistant Examiner*—Rodney Butler
*Attorney, Agent, or Firm*—Armstrong, Westerman, Hattori, McLeland & Naughton

[57] ABSTRACT

An apparatus for forming a snap ring groove in a clutch drum by pressing a lower die, an upper die, a workpiece supporting member, first sliding members and second sliding members, a workpiece receiving member fixed on a radially inner end of each first sliding member, and a punch fixed on an upper end of each upwardly bent portion in a radially inner end portion of each second sliding member. The first sliding members and the second sliding members are pushed radially inwards and outwards, respectively, via a cam mechanism by lowering the upper die. The cam mechanism is made of a first cam mechanism for driving the first sliding members and a second cam mechanism for driving the second sliding members. The first cam mechanism is arranged to push the first sliding members radially inwards, when lowering the upper die, with a radially outer end portion thereof operating as a point of action. The second cam mechanism is arranged to push the second sliding members radially outwards, when lowering the upper die, with a radially inward end portion operating as a point of action.

3 Claims, 4 Drawing Sheets

APPARATUS FOR FORMING SNAP RING GROOVE IN CLUTCH DRUM

BACKGROUND OF THE INVENTION

1. Field of the Invention

The present invention relates to an apparatus for forming by pressing a snap ring groove which extends in a circumferential direction along a tooth crest portion (or in a top of each tooth) of an internal tooth spline (or internally toothed spline) formed on a circumferential wall portion of a clutch drum, and which prevents clutch plates to be mounted inside the clutch drum from being pulled out of position.

2. Description of Related Art

As this kind of apparatus, there is conventionally known one which is disclosed in Japanese Published Examined Utility Model Registration Application No. 41858/1991.

This apparatus comprises a lower (or bottom) die and an upper (or top) die which is movable up and down. On the lower die there is provided, in a vertically extending manner, a workpiece supporting member onto an external surface of which a clutch drum can be set into position. Outside an area in which the workpiece supporting member is disposed, there are provided in upper and lower two stages first sliding members and second sliding members which are slidable in a radial direction of the clutch drum. To a radially inner end portion of each of the upper first sliding members, there is fixed a workpiece receiving member which is capable of contacting an external surface of the clutch drum. On a radially inner end portion of each of the lower second sliding members, there is formed an upward bent portion. On an upper end of each of the bent portions, there is fixed a punch which can contact or abut each tooth crest portion (i.e., top of each tooth) of an internal tooth spline (or internally toothed spline). The first and the second sliding members are urged or pushed in radially inward and radially outward directions, respectively, via a cam mechanism by a downward movement of the upper die. In a condition in which the workpiece receiving member is in contact with the peripheral surface of the clutch drum, the punches are thrusted into the tooth crest portion of the internal tooth spline, thereby forming a snap ring groove.

In this apparatus the cam mechanism is arranged as follows. Namely, driving cams which can contact the radially outer end portion of the first sliding members are vertically downwardly provided on the upper die. The second sliding members are extended up to a position outside the driving cams, and an upward bent portion is formed on an outer end of each of the second sliding members. By the downward movement of the driving cams the first sliding members are pushed radially inwards with the radially outer end portion thereof working as a point of action. Also, the second sliding members are pushed radially outwards with the bent portion on the radially outward end thereof working as a point of action.

In the above-described apparatus there are the following disadvantages. Namely, since the point of action of the cam mechanism relative to the second sliding members become the bent portion on the outer end of each of the second sliding members, the distance between a punch which is mounted on the bent portion of the inner end of each of the second sliding members and the point of action becomes large. As a result, the second sliding members are likely to give rise to a flexure at the time of forming. It follows that none of the punches can be thrust into a required depth of the tooth crest portion of the internal tooth spline, resulting in a poor forming accuracy of the snap ring groove.

SUMMARY OF THE INVENTION

In view of the above-described disadvantages, the present invention has an object of providing an apparatus for forming a snap ring groove at a higher accuracy.

In order to attain the above object, the present invention is an apparatus for forming a snap ring groove in a clutch drum by pressing so as to extend in a circumferential direction along a tooth crest portion of an internal tooth spline formed in a circumferential wall portion of the clutch drum, the apparatus having: a lower die and an upper die which is movable up and down; a workpiece supporting member which is provided on the lower die in a vertically extending manner and onto a periphery of which the clutch drum can be set in position; first sliding members and second sliding members which are provided in upper and lower two stages outside a position in which the workpiece supporting member is disposed and which are slidable in a radial direction of the clutch drum; a workpiece receiving member which is fixed on a radially inner end portion of each of the upper-stage first sliding members so as to contact a peripheral surface of the clutch drum; each of the lower-stage second sliding members having an upwardly bent portion which is formed in a radially inner end portion thereof; and a punch which is fixed to an upper end of each of the bent portions so as to contact the tooth crest portion of the internal tooth spline, such that the first sliding members and the second sliding members are pushed radially inwards and outwards, respectively, via cam mechanism means by lowering the upper die, whereby the snap ring groove is formed by thrusting each of the punches into the tooth crest portion of the internal tooth spline in a condition in which each of the workpiece receiving members is in contact with the peripheral surface of the clutch drum; wherein the cam mechanism means comprises a first cam mechanism for driving said first sliding members and a second cam mechanism for driving the second sliding members; the first cam mechanism being arranged to push the first sliding members radially inwards, when lowering the upper die, with a radially outer end portion of the first sliding members operating as a point of action; the second cam mechanism being arranged to push the second sliding members radially outwards, when lowering the upper die, with a radially inward end portion of the second sliding members operating as a point of action.

When the upper die is lowered, the first sliding members are pushed radially inwards by the first cam mechanism and consequently the workpiece receiving members come into contact with the peripheral surface of the clutch drum. Also, the second sliding members are pushed radially outwards by the second cam mechanism, whereby the punches are thrusted into the tooth crest portion of the internal tooth spline, thereby forming the snap ring groove. Here, since the point of action of the second cam mechanism on the second sliding members is in the radially inner end portion of the second sliding members, the second sliding members are pushed radially outwards at as near a point as possible to the punches which are mounted on the bent portions on the inner end of the second sliding members. Therefore, there will occur no deterioration in accuracy in forming the snap ring groove due to deflection of the second sliding members.

The first cam mechanism is made up of driving cams which are provided on the upper die in a downwardly projecting manner and which come into contact with the radially outer end portion of the first sliding members when lowering the upper die. The second cam mechanism may also be considered to be arranged as follows. Namely, the workpiece supporting member is formed into a hollow and the driving cam of the second cam mechanism which is lowered by lowering the upper die is inserted into the workpiece supporting member. Further, the second sliding members are extended radially inwards to project into the workpiece supporting member, and the second sliding members are pushed radially outwards with this projected end operating as the point of action for contacting the driving cam of the second cam mechanism. However, since the second sliding members must be provided in the same number as that of the teeth of the internal spline, the circumferential width of the projected end of each of the second sliding members must necessarily be kept relatively small in order to project the second sliding members into the workpiece supporting member as described above. It follows that the area of contact of the second sliding members with the second driving cam becomes smaller, with the result that the bearing pressure becomes large and the durability becomes poor.

On the other hand, if the second cam mechanism comprises: a driving cam which is pushed down by lowering the upper die; first following cams (or driven cams) which are pushed to radial one direction by lowering the driving cam; a second following cam (or driven cam) which is disposed around a lower periphery of the workpiece supporting member and which is pushed upwards by the movement of the first following cams in the radial one direction, such that, by lifting the second following cam, the second following cam is contacted with a radially inner end portion of the second sliding members, whereby the second sliding members are pushed radially outwards, it becomes possible to bring the inner end portion of the second sliding members into contact with the second following cam outside the workpiece supporting member where there is an allowance in space in the circumferential direction. As a result, a large area of contact of the second sliding members with the second following cam can be secured, resulting in an improved durability.

By the way, a horizontal forming reaction force occurs to the punches when forming the groove as a result of thrusting of the punches into the tooth crest portion of the internal tooth spline. Bending stresses due to the forming reaction forces are therefore operated on the punch mounting portions of the bent portions of the second sliding members. Due to repeated forming work, the punch mounting portions may be subject to fatigue and there occurs, in the bent portions, cracks which originate from the punch mounting portions.

In this case, if an upper edge of a sliding portion of the second sliding members relative to the second following cam is equal to, or higher than, a level at which the punches are disposed, and the second following cam contacts the sliding portion over an entire upper edge thereof in a condition in which the punches are thrusted into the tooth crest portion of the internal tooth spline, the forming reaction force to operate on the punches can be received by the second following cam on the line of action. Consequently, there will operate no bending stresses any more on punch mounting portions of the second sliding members, with the result that the forming accuracy of the snap ring groove can further be improved, the punch mounting portions are less likely to be subject to fatigue, and the durability is improved.

When the second cam mechanism is made up, as described above, of the driving cam, the first following cams, and the second following cam, there is considered, as a first embodying example, a type in which the second following cam is pushed upwards by pushing radially outwards the first following cams by lowering the driving cam and, as a second embodying example, a type in which the second following cam is pushed upwards by pushing the first following cams radially inwards by lowering the driving cam. In the first embodiment, the workpiece supporting member is formed into a hollow so as to insert the driving cam of the second cam mechanism into the workpiece supporting member in a manner movable up and down, and the first following cams are inserted into guide holes formed in a lower portion of the workpiece supporting member in a manner slidable in a radial direction, such that the first following cams are pushed radially outwards by lowering the driving cam of the second cam mechanism, and in the second embodiment, the first following cams are provided under the second sliding members so as to be radially slidable, and the driving cam of the second cam mechanism is provided so as to contact a radially outer end portion of the first following cams, such that the first following cams are pushed radially inwards by lowering the driving cam of the second cam mechanism.

By the way, when lifting the upper die, the workpiece receiving members and the punches must be detached from the peripheral surface of the clutch drum and the tooth crest portion of the internal tooth spline, respectively, by returning the first sliding members and the second sliding members radially outwards and radially inwards, respectively. For that purpose, conventionally, the first sliding members and the second sliding members are pushed or forced radially outwards and radially inwards, respectively, by separate pushing members. This arrangement, however, requires that a large number of pushing members be assembled into the die, resulting in a complicated structure.

On the contrary, if an arrangement is made such that a downwardly bent portion is formed in a radially outward end portion of each of the first sliding members with a radial clearance to a radially outer end portion of the second sliding members, and an annular return cam which is coaxial with the workpiece supporting member is provided on the lower die in a manner pushed upwards so that the return cam is arranged to proceed into the clearance from a bottom upwards so as to return the first sliding members and the second sliding members radially outwards and radially inwards respectively, such that, when lowering the upper die, the return cam is pushed down by the driving cams of the first cam mechanism, all of the first sliding members and the second sliding members can be returned, when lifting the upper die, radially outwards and radially inwards, respectively, by a single number of return cam. The construction can therefore be simplified. When the upper die is lowered, the return cam is pushed downwards by the driving cams of the first cam mechanism. Therefore, the first sliding members and the second sliding members can be pushed radially inwards and radially outwards, respectively, by the first and the second cam mechanisms without interfering with the rerun cam. In the above-described second embodying example of the second cam mechanism, the above-described driving cam of the second cam mechanism can be integrally provided with the return cam to attain a further simplification of the construction.

The conventional punches which are used in the apparatus of the above-described Japanese Published Examined Utility Model Registration Application No. 41858/1991 are each provided with a groove forming blade which is thrusted into the tooth crest portion of the internal tooth spline, and a pair of restriction portions which project forwards from lengthwise both ends of the groove forming blade and which can contact the tooth flanks of the internal tooth spline. It is thus so arranged that the protrusion of the thrusted material towards the tooth flanks as a result of thrusting of the groove forming blade into the tooth crest portion can be restricted by the restriction portions. However, the above-described punch is of a plate shape and the restriction portions are formed in the same thickness as the groove forming blade. Therefore, the protruding of the material in the direction of the thickness of the groove forming blade cannot be restricted. If the snap ring is formed with these punches, there will occur some degree of burs on the tooth flanks of the internal tooth spline at both edge portions in the width direction of the snap ring groove. It therefore becomes necessary to remove the burs in a succeeding machining step.

Then, according to another feature of the present invention, the restriction portion to be formed in each punch is projected in both directions of the blade thickness of the groove forming blade. According to this arrangement, it becomes possible to restrict the protrusion of the thrusted material not only at the front end of thrusting of the groove forming blade but also on both sides in the direction of the blade thickness. Therefore, in the tooth flanks of the internal tooth spline there will occur no burs even in both edge portions in the direction of groove width of the snap ring groove. Removal of burs in a succeeding step thus becomes needless, and the productivity improves.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 7:
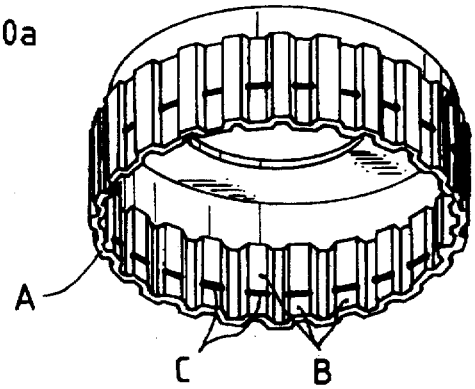
FIG. 7 is a perspective view showing a clutch drum.

An illustrated embodiment is one in which the present invention is applied to an apparatus for forming by pressing a snap ring groove C which extends in a circumferential direction in a tooth crest portion (or in a top of each tooth) B of an internal tooth spline (or internally toothed spline) which is formed on a circumferential wall portion of a clutch drum A as shown in FIG. 7. Into the snap ring groove C there is to be fitted a snap ring for preventing clutch plates which are mounted inside the clutch drum A in engagement with the internal tooth spline, from being pulled out of position.

Figure 1:
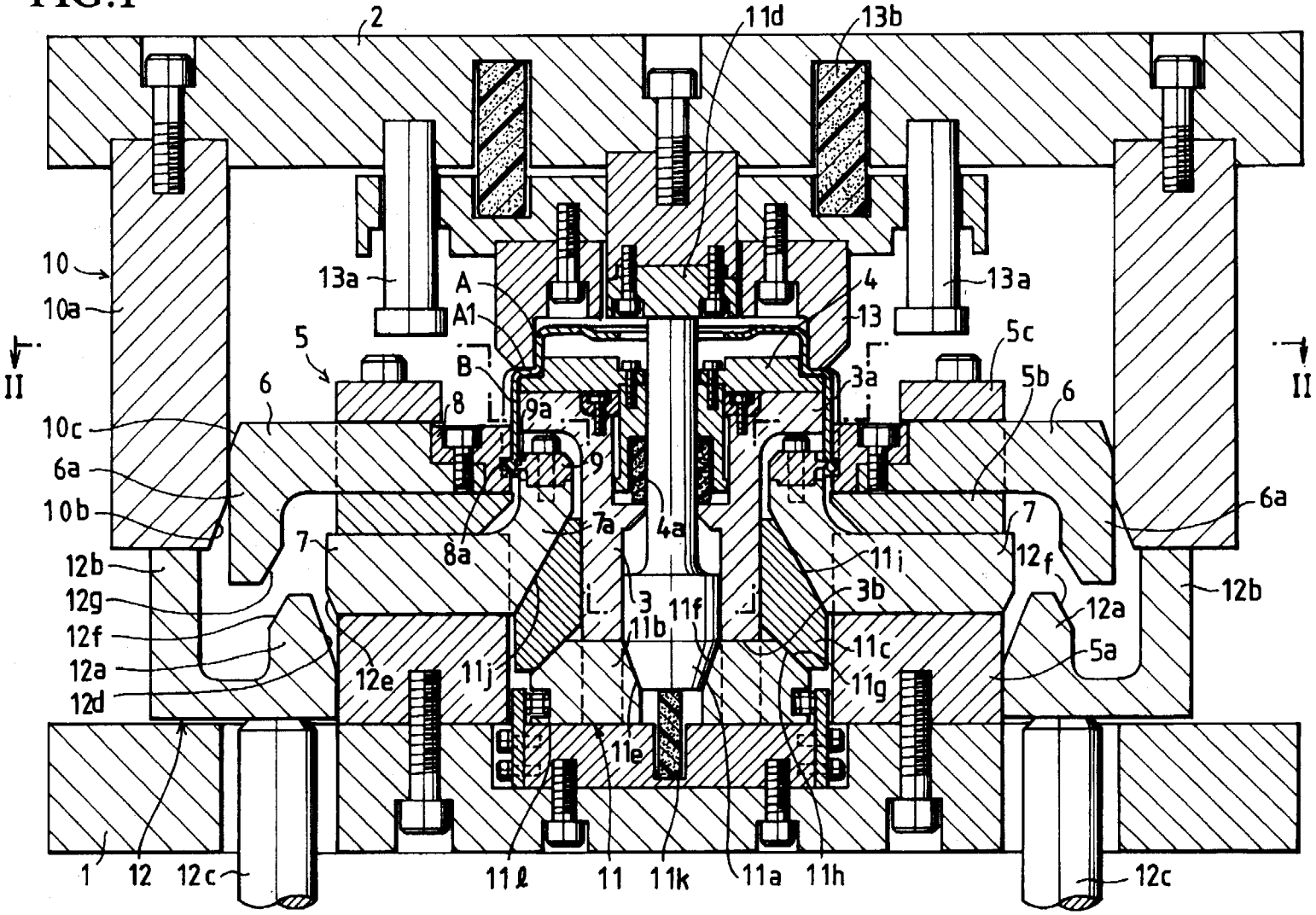
FIG. 1 is a sectional side view of a first embodiment of the apparatus of the present invention.

An apparatus for forming the snap ring groove C is provided, as shown in FIG. 1, with a lower die (or bottom die) 1 and an upper die (or top die) 2 which is moved up and down by a ram (not shown). On the lower die 1 there is provided in an upwardly extending manner a hollow workpiece supporting member 3 onto an outer surface of which the clutch drum A can be inserted for setting in position. On an upper end of the workpiece supporting member 3 there is formed a flange portion 3*a* of a larger diameter. On a periphery of the flange portion 3*a* there is formed a tooth profile which comes into engagement with the internal tooth spline of the clutch drum A. On top of the flange portion 3*a* there is provided a knockout plate 4 which is pushed upwards by springs 4*a*.

On the lower die 1 there is provided a cylindrical guide block 5 in a manner to enclose the workpiece supporting member 3. In the guide block 5 there are supported upper first sliding members 6 and lower second sliding members 7 in a manner respectively slidable in a radial direction of the clutch drum A. The guide block 5 is made up of three members of a lower block 5*a* for supporting the second sliding members 7, an upper block 5*b* for supporting the first sliding members 6, and an upper cover member 5*c*.

Figure 2:
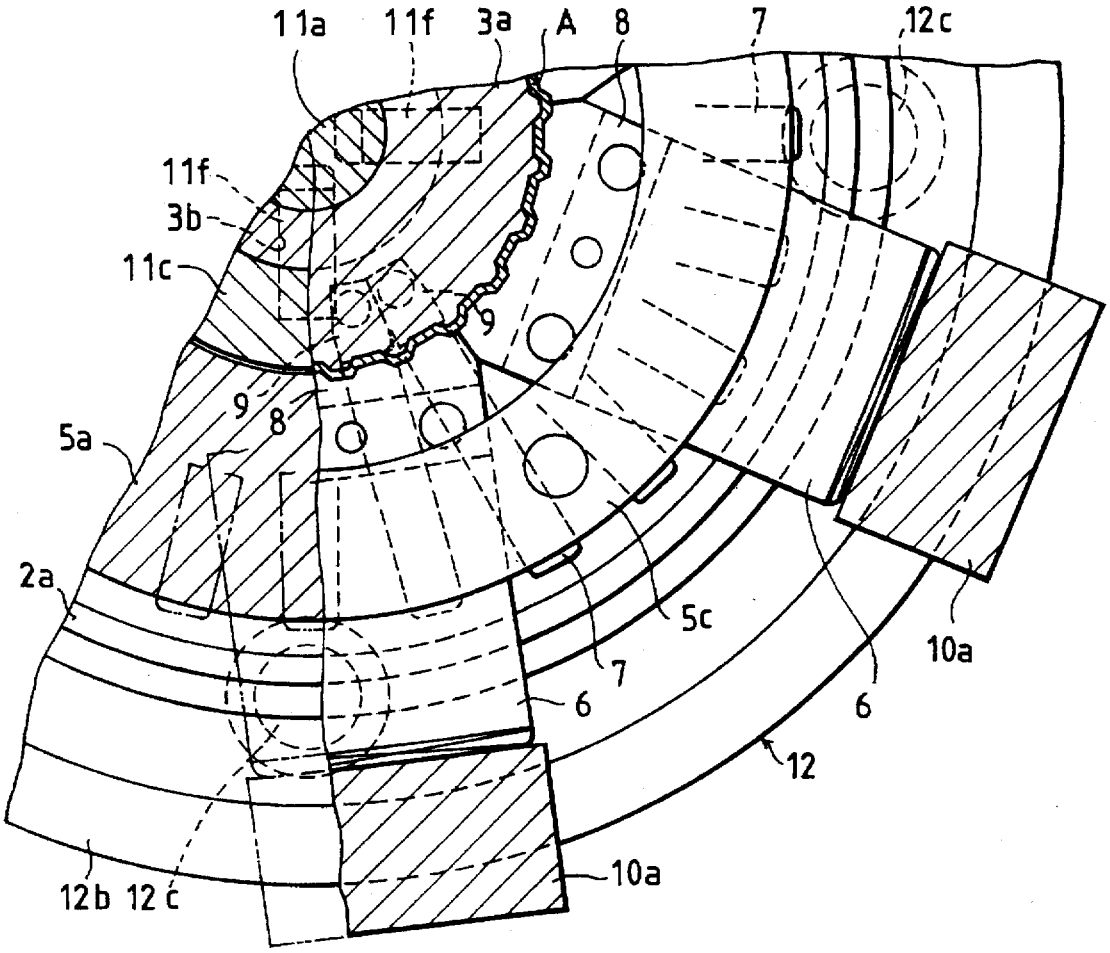
FIG. 2 is a plan view taken along the line II—II in FIG. 1.

The first sliding members 6 are provided in a plurality of pieces at an equal pitch in the circumferential direction, e.g., 6 pieces at a pitch of 60°. On a radially inner end portion of each of the first sliding members 6 there is mounted a workpiece receiving member 8 which comes into contact with the peripheral surface of the clutch drum A. As shown in FIG. 2, on a radially inner end surface of each workpiece receiving member 8, there are formed teeth which fit into a recessed portion on a peripheral surface of the clutch drum A, the recessed portion coinciding with the tooth crest portion B of the internal tooth spline. Further, there is formed a recessed groove 8*a* in a position which coincides with the snap ring groove C in the teeth, the recessed groove serving as a space for receiving the protruded or pushed material at the time of forming the snap ring groove.

Figure 3:
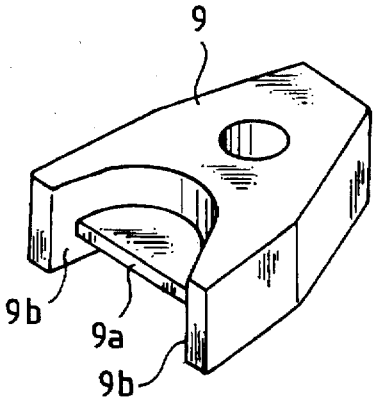
FIG. 3 is a perspective view of a punch.

The second sliding members 7 are provided in the same number as the number of teeth of the internal tooth spline. In an inner end portion of each of the second sliding members 7, there is formed a bent portion 7*a* which extends upwards in a space under the flange portion 3*a* of the workpiece supporting member 3. On an upper end of each bent portion 7*a* there is mounted a punch 9 so as to look radially outwards. On a front end of each punch 9 there are formed, as shown in FIG. 3, a groove-forming blade 9*a* which is to be thrust into the tooth crest portion B of the internal tooth spline, and restricting portions 9*b*, 9*b* which project forwards from both lengthwise ends of the groove-forming blade 9*a* so as to contact the tooth side surfaces (or tooth flanks) on both sides in the tooth crest portion and which extend in both sides as seen in the direction of thickness of the groove-forming blade 9*a*.

The first sliding members 6 are arranged to be pushed radially inwards via a first cam mechanism 10 by the downward movement of the upper die 2. The second sliding members 7 are arranged to be pushed radially outwards via a second cam mechanism 11 by the downward movement of the upper die 2.

In more detail, the first cam mechanism 10 is made up of first driving cams 10*a*, each being respectively provided on the upper die 2 in a downwardly projecting manner so as to correspond to each of the first sliding members 6. Upon downward movement of the upper die 2 an inclined surface 10*b* which is formed on an inner lower end portion of each first driving cam 10*a* is brought into contact with an inclined surface 10*c* which is formed on a radially outer end portion of each first sliding member 6, whereby each of the first sliding members 6 is pushed radially inwards.

The second cam mechanism 11 is made up of a second driving cam 11*a* which is inserted into the workpiece supporting member 3 so as to be movable up and down, first following cams 11b which are radially slidably provided through radial guide holes 3b formed in the lower portion of the workpiece supporting member 3, and a second cylindrical following cam 11c which is inserted onto the peripheral surface of the lower portion of the workpiece supporting member 3 so as to be movable up and down. By the downward movement of the upper die 2 the second driving cam 11a is pushed down via a contact portion 11d which is fixed to the upper die 2. A tapered surface 11e at the lower end of the second driving cam 11a then comes into contact with an inclined surface 11f on a radially inner end of each of the first following cams 11b, so that the first following cams 11b are pushed radially outwards. As a result, an inclined surface 11g on a radially outer end of the first following cams 11b comes into contact with a tapered surface 11h on a lower portion of the second following cam 11c, so that the second following cam 11c is pushed upwards. A tapered surface 11i on an upper portion of the second following cam 11c comes into contact with an inclined surface 11j on a radially inner end of each of the second sliding members 7, so that each of the second sliding members 7 is pushed radially outwards. The first following cams 11b are provided in 4 pieces at a pitch of 90° so as to uniformly push the second driving cam 11c at four peripheral points. The number of the first following cams 11b may also be three. In any case, the number of the first following cams 11b may be far smaller than that of the second sliding members 7 which are provided in the same number as the number of teeth of the internal tooth spline. The circumferential width in the radially inner end portion of the first following cams 11b which project into the workpiece supporting member 3 can be maintained large. Therefore, the bearing pressure to act on the inclined surface 11f on the internal end of each of the first following cams 11b can be reduced. Further, since the radially inner end portion of each second sliding member 7 lies outside the workpiece supporting member 3, its circumferential width can be maintained relatively large. As a result, the bearing pressure to act on the inclined surface 11j on the inner end of each second sliding member 7 does not amount to a large value, and the durability of the second cam mechanism 11 can thus be improved.

When the upper die 2 is lifted, the second driving cam 11a is returned upwards by a spring 11k and also the first following cams 11b are returned radially inwards by springs 11l. The second following cam 11c is thus returned downwards and, furthermore, the first sliding members 6 and the second sliding members 7 are returned by a return cam 12 radially outwards and radially inwards, respectively. The workpiece receiving members 8 and the punches 9 are thus detached from the peripheral surface of the clutch drum A and the tooth crest portion B, respectively.

The return cam 12 is formed into an annular shape concentrically with the workpiece supporting member 3 such that the return cam 12 is inserted onto the periphery of the guide block 5 in a manner movable up and down. On a radially outer end portion of each of the first sliding members 6, there is formed a downwardly bent portion 6a which opposes or faces the radially outer end portion of the second sliding member 7 with a radial clearance thereto. In the return cam 12 there is provided in a projecting manner a cam portion 12a which faces the clearance, and is also provided, in a projecting manner, a contact portion 12b which faces the lower end of the first driving cams 10a. The return cam 12 is pushed or forced by cushion pins 12c which are provided in circumferential four points to serve as pushing means. When the upper die 2 is moved upwards, the return cam 12 is lifted by the pushing force of the cushion pins 12c, and the cam portion 12a proceeds into the clearance. Then, a tapered surface 12d on an inner circumference of the cam portion 12a comes into contact with an inclined surface 12e on a radially outer end of each of the second sliding members 7, so that the second sliding members 7 are returned radially inwards. At the same time, a tapered surface 12f on a periphery of the cam portion 12a comes into contact with an inclined surface 12g on the lower end of the bent portion 6a of each of the first sliding members 6, so that the first sliding members 6 are returned radially outwards.

On the upper die 2 there is provided a workpiece holding member 13, aside from the above-described first driving cams 10a and the contact portion 11d. The workpiece holding member 13 is supported in a vertically movable manner by guide bars 13a which are provided on the upper die 2 in a vertically downwardly extending manner, and is pushed downwards by springs 13b. The above-described springs 4a, 11k, 13b are made of urethane rubber.

In forming the snap ring groove C, the clutch drum A is set in position on the periphery of the workpiece supporting member 3 in a condition in which the upper die 2 is lifted, and thereafter the upper die 2 is lowered. According to this operation, the workpiece holding member 13 first comes into contact with a shoulder portion Al of the clutch drum A to thereby lower the clutch drum A together with the knockout plate 4 against the pushing force of the springs 4a. The portion where the snap ring groove C is formed thus lies between the workpiece receiving members 8 and the punches 9. Then, the first driving cams 10a come into contact with the contact portion 12b of the return cam 12, whereby the return cam 12 is lowered. Further, by means of the first driving cams 10a the first sliding members 6 are pushed radially inwards, whereby workpiece receiving members 8 come into contact with the peripheral surface of the clutch drum A. Thereafter, the second driving cam 11a is lowered to thereby push the second sliding members 7 radially outwards via the first following cams 11b and the second following cam 11c.

Figure 4:
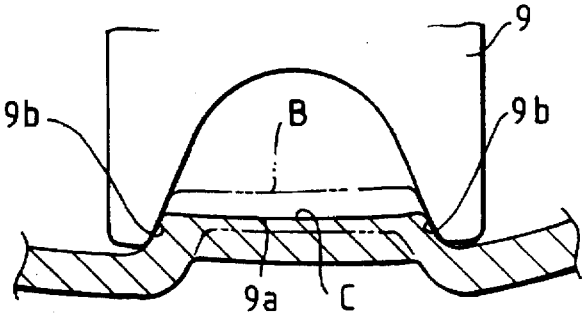
FIG. 4 is an enlarged plan view showing the condition of forming a snap ring groove.

According to this operation, the groove forming blade 9a of each punch 9 is thrusted into the tooth crest portion B of the internal tooth spline as shown in FIGS. 1 and 4, thereby forming the snap ring groove C by pressing. In this case, according to the present embodying example, the second sliding members 7 are forced radially outwards by the second cam mechanism 11 in as close a position to the punches 9 as possible. Therefore, each tooth forming blade 9a is thrusted up to a required depth in the tooth crest portion B without being affected by the deflection of the second sliding members 7, with the result that the snap ring groove C can be formed at a higher accuracy.

Further, as a result of the thrusting of each groove forming blade 9a, the thrusted material is likely to protrude towards the tooth flanks at the tooth crest portion B. However, due to the restriction portions 9b, 9b formed in the punch 9, there can be prevented not only the protruding of thrusted material in front of each groove forming blade 9a in the direction of thrusting but also the protruding of the thrusted material at both sides in the direction of width of the groove forming blade 9a. It follows that burs will not occur in the tooth flanks even at both edge portions in the width direction of the snap ring groove C and therefore that no removal of burrs is necessary in a step to follow.

Once the snap ring groove C has been formed in the above-described manner, the upper die 2 is lifted. According to this operation, the first sliding members 6 and the second sliding members 7 are returned radially outwards and radially inwards, respectively, by the upward movement of the return cam 12. The workpiece receiving members 8 and the punches 9 are detached from the peripheral surface of the clutch drum A and the tooth crest portion B, respectively. Then, the clutch drum A is lifted by the knockout plate 4 as a result of the releasing of restriction of the clutch drum A by the workpiece holding member 13. When the upper die 2 has been completely lifted, the clutch drum A is taken out of the workpiece holding member 3, thereby completing one cycle of works.

Figure 6:
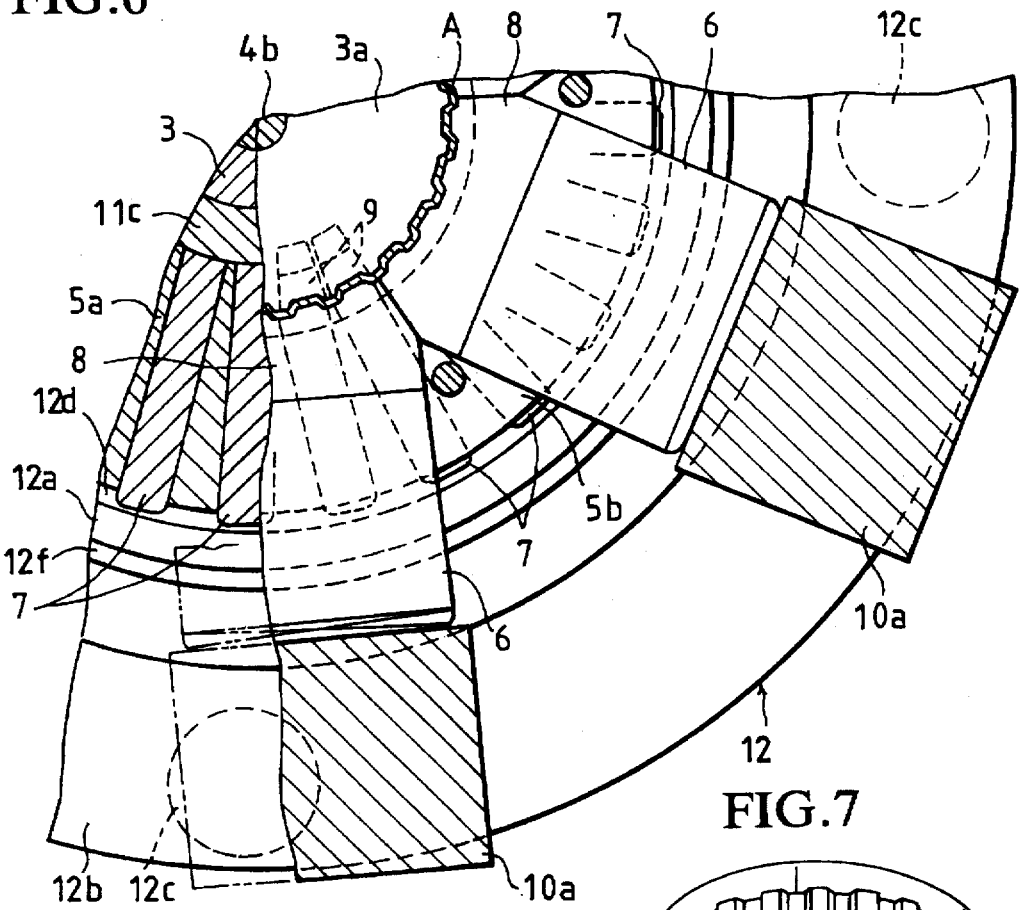
FIG. 6 is a plan view taken along the line VI—VI in FIG. 5.
Figure 5:
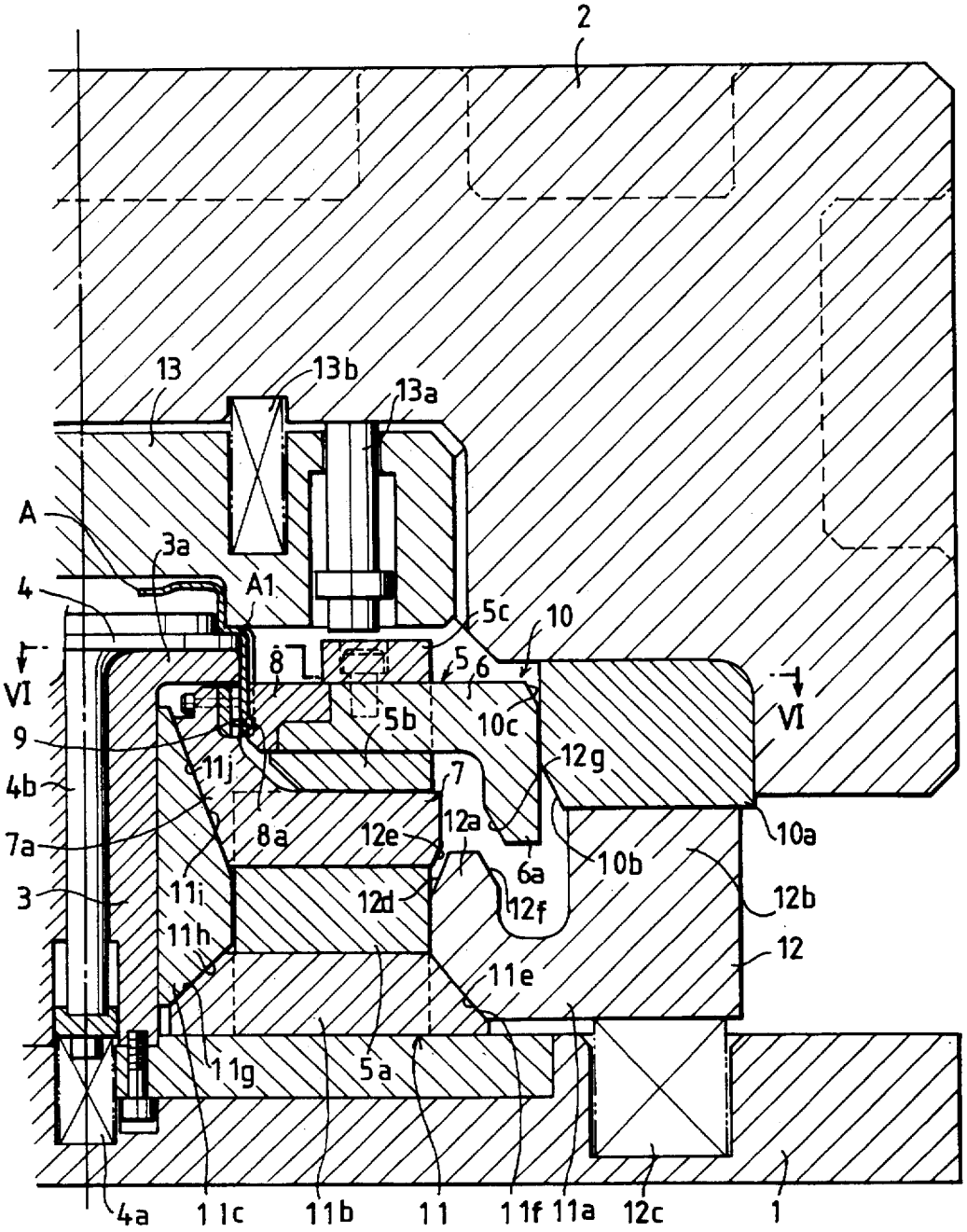
FIG. 5 is a sectional view of a second embodying example of the apparatus of the present invention.

FIGS. 5 and 6 show a second embodiment of the apparatus of the present invention. The same reference numerals were used to the members having the same function as those in the above-described first embodiment. The main difference between the first embodiment and the second embodiment lies in the construction of the second cam mechanism 11 to drive the second sliding members 7. An explanation will now be made hereinbelow about the difference.

The second cam mechanism 11 of the second embodiment is provided with first following cams **11*b* which are inserted into a guide block 5 in a position under second sliding members 7 so as to be slidable in the radial direction, and a second following cam 11*c* which is inserted onto the lower peripheral surface of a workpiece holding member 3 so as to be slidable up and down. A return cam 12 is arranged to serve also as the driving cam of a second cam mechanism 11, i.e., arranged as a second driving cam 11*a* so as to cooperate with the first following cams 11*b*. When the return cam 12 is pushed downwards via driving cams 10*a* of a first cam mechanism 10 by the lowering of an upper die 2, a tapered surface 11*e* on the inner lower portion of the return cam 12, which serves as the second driving cam 11*a*, comes into contact with an inclined surface 11*f* on a radially outer end of the first following cams 11*b*. The first following cams 11*b* are thus pushed radially inwards, and an inclined surface 11*g* on a radially inner end of each of the first following cams 11*b* comes into contact with a lower tapered surface 11*h* of the second following cam 11*c*, whereby the second following cam 11*c* is pushed upwards. An upper tapered surface 11*i* of the second following cam 11*c* thus comes into contact with an inclined surface 11*j* on a radially inner end of each of the second sliding members 7, whereby the second sliding members 7 are pushed radially outwards. The first following cams 11*b* are provided in a plurality of pieces at an equal pitch in the circumferential direction so that the second following cam 11*c*** can be pushed upwards uniformly at a plurality of peripheral points.

The inclined surface **11*j* which becomes the sliding portion of each of the second sliding members 7 relative to the second following cam 11*c* is formed such that the upper end thereof becomes equal to or above the height at which each punch 9 is disposed. In a condition in which the punches 9 are thrusted into the tooth crest portion B of the internal tooth spline, the second following cam 11*c* is arranged to come into contact with the inclined surface 11*j* over the entire upper edge thereof. As a result, the horizontal forming reaction forces which operate on the punches 9 at the time of forming the snap ring groove C are received by the second following cam 11*c* on the line of action of the reaction forces. Therefore, there is applied no bending stress, due to the forming reaction force, to the punch mounting portion of a bent portion 7*a* of each of the second sliding members 7**. The punch mounting portion can thus be effectively prevented from giving rise to cracks due to fatigue.

Though the first embodiment does not the construction of the above-described second embodying example in that the second following cam **11*c* is brought into contact with the second sliding members 7 in a range above the position in which the punches 9** are disposed, this construction may also be applied to the first embodiment.

Further, in the second embodiments, since the second driving cam **11*a* is not internally inserted into the workpiece supporting member 3, a rod 4*b* which is provided in a downwardly projecting manner on a knockout plate 4 is internally inserted into the workpiece supporting member 3 to thereby push the knockout plate 4 upwards by means of a pushing means 4*a* which is provided in a lower portion of the workpiece supporting member 3**.

It is readily apparent that the above-described apparatus for forming a snap ring groove in a clutch drum meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An apparatus for forming a snap ring groove in a clutch drum by pressing so as to extend in a circumferential direction along a tooth crest portion of an internal tooth spline formed in a circumferential wall portion of the clutch drum, said apparatus comprising:

a lower die and an upper die which is movable up and down;

a workpiece supporting member which is provided on said lower die in a vertically extending manner and onto a periphery of which the clutch drum is positioned;

first sliding members and second sliding members which are provided in upper and lower two stages outside a position in which said workpiece supporting member is disposed and which are slidable in a radial direction of the clutch drum;

a workpiece receiving member which is fixed on a radially inner end portion of each of said upper-stage first sliding members so as to contact a peripheral surface of the clutch drum;

each of said lower-stage second sliding members having an upwardly bent portion which is formed in a radially inner end portion thereof; and a punch which is fixed to an upper end of each of said bent portions so as to contact the tooth crest portion of the internal tooth spline, such that said first sliding members and said second sliding members are pushed radially inwards and outwards, respectively, via cam mechanism means by lowering said upper die, whereby the snap ring groove is formed by thrusting each of said punches into said tooth crest portion of the internal tooth spline in a condition in which each of the workpiece receiving members is in contact with the peripheral surface of the clutch drum, wherein said cam mechanism means comprises a first cam mechanism for driving said first sliding members and a second cam mechanism for driving said second sliding members, said first cam mechanism being arranged to push said first sliding members radially inwards, when lowering said upper die, with a radially outer end portion of said first sliding members operating as a point of action, said second cam mechanism being arranged to push said second sliding members radially outwards, when lowering said upper die, with a radially inward end portion of said second sliding members operating as a point of action, wherein said second cam mechanism comprises:

a driving cam which is pushed down by lowering said upper die;

first following cams which are pushed to radial one direction by lowering said driving cam; and a second following cam which is disposed around a lower periphery of said workpiece supporting member and which is pushed upwards by the movement of said first following cams in said radial one direction, such that, by lifting said second following cam, said second following cam is contacted with a radially inner end portion of said second sliding members, whereby said second sliding members are pushed radially outwards, wherein said workpiece supporting member is formed into a hollow so as to insert said driving cam of said second cam mechanism into said workpiece supporting member in a manner movable up and down, and wherein said first following cams are inserted into guide holes formed in a lower portion of said workpiece supporting member in a manner slidable in a radial direction, such that said first following cams are pushed radially outwards by lowering said driving cam of said second cam mechanism;

wherein said first cam mechanism comprises:

driving cams which are provided on said upper die so as to contact a radially outward end portion of said first sliding members when lowering said upper die;

a downwardly bent portion which is formed in a radially outward end portion of each of said first sliding members with a radial clearance to a radially outer end portion of said second sliding members; and an annular return cam which is provided on said lower die in a manner pushed upwards and which is coaxial with said workpiece supporting member, said return cam being arranged to proceed into said clearance from a bottom upwards so as to return said first sliding members and said second sliding members radially outwards and radially inwards respectively, such that, when lowering said upper die, said return cam is pushed down by said driving cams of said first cam mechanism.

2. An apparatus for forming a snap ring groove in a clutch drum according to claim 1, wherein an upper edge of a sliding portion of said second sliding members relative to said second following cam is equal to, or higher than, a level at which said punches are disposed, and said second following cam contacts said sliding portion over an entire upper edge thereof in a condition in which said punches are thrusted into the tooth crest portion of the internal tooth spline.

3. An apparatus for forming a snap ring groove in a clutch drum, by pressing so as to extend in a circumferential direction along a tooth crest portion of an internal tooth spline formed in a circumferential wall portion of the clutch drum, said apparatus comprising:

a lower die and an upper die which is movable up and down;

a workpiece supporting member which is provided on said lower die in a vertically extending manner and onto a periphery of which the clutch drum is positioned;

first sliding members and second sliding members which are provided in upper and lower two stages outside a position in which said workpiece supporting member is disposed and which are slidable in a radial direction of the clutch drum;

a workpiece receiving member which is fixed on a radially inner end portion of each of said upper-stage first sliding members so as to contact a peripheral surface of the clutch drum;

each of said lower-stage second sliding members having an upwardly bent portion which is formed in a radially inner end portion thereof; and a punch which is fixed to an upper end of each of said bent portions so as to contact the tooth crest portion of the internal tooth spline, such that said first sliding members and said second sliding members are pushed radially inwards and outwards, respectively, via cam mechanism means by lowering said upper die, whereby the snap ring groove is formed by thrusting each of said punches into said tooth crest portion of the internal tooth spline in a condition in which each of the workpiece receiving members is in contact with the peripheral surface of the clutch drum, wherein said cam mechanism means comprises a first cam mechanism for driving said first sliding members and a second cam mechanism for driving said second sliding members, said first cam mechanism being arranged to push said first sliding members radially inwards, when lowering said upper die, with a radially outer end portion of said first sliding members operating as a point of action, said second cam mechanism being arranged to push said second sliding members radially outwards, when lowering said upper die, with a radially inward end portion of said second sliding members operating as a point of action, wherein said second cam mechanism comprises:

a driving cam which is pushed down by lowering said upper die;

first following cams which are pushed to radial one direction by lowering said driving cam; and a second following cam which is disposed around a lower periphery of said workpiece supporting member and which is pushed upwards by the movement of said first following cams in said radial one direction, such that, by lifting said second following cam, said second following cam is contacted with a radially inner end portion of said second sliding members, whereby said second sliding members are pushed radially outwards, wherein said first following cams are provided under said second sliding members so as to be radially slidable, and wherein said driving cam of said second cam mechanism is provided so as to contact a radially outer end portion of said first following cams, such that said first following cams are pushed radially inwards by lowering said driving cam of said second cam mechanism, wherein said first cam mechanism comprises:

driving cams which are provided on said upper die so as to contact a radially outward end portion of said first sliding members when lowering said upper die;

a downwardly bent portion which is formed in a radially outward end portion of each of said first sliding members with a radial clearance to a radially outer end portion of said second sliding members; and an annular return cam which is provided on said lower die in a manner pushed upwards and which is coaxial with said workpiece supporting member, said return cam being arranged to proceed into said clearance from a bottom upwards so as to return said first sliding members and said second sliding members radially outwards and radially inwards respectively, such that, when lowering said upper die, said return cam is pushed down by said driving cams of said first cam mechanism, said driving cam of said second cam mechanism being provided integrally with said return cam.

* * * * *